US011078747B2

(12) United States Patent
Hedrick et al.

(10) Patent No.: US 11,078,747 B2
(45) Date of Patent: Aug. 3, 2021

(54) MECHANISM FOR RETAINING AND RELEASING PUMP DOWN PLUG

(71) Applicants: Marcelle H. Hedrick, Kingwood, TX (US); Ryan Faul, Houston, TX (US); William Cauley, Houston, TX (US); Robert Pena, Houston, TX (US); Sean Yakeley, Houston, TX (US)

(72) Inventors: Marcelle H. Hedrick, Kingwood, TX (US); Ryan Faul, Houston, TX (US); William Cauley, Houston, TX (US); Robert Pena, Houston, TX (US); Sean Yakeley, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/731,810

(22) Filed: Dec. 31, 2019

(65) Prior Publication Data

US 2021/0198972 A1 Jul. 1, 2021

(51) Int. Cl.
*E21B 33/128* (2006.01)
*E21B 34/14* (2006.01)

(52) U.S. Cl.
CPC ..... *E21B 33/128* (2013.01); *E21B 34/14* (2013.01)

(58) Field of Classification Search
CPC ..... E21B 34/14; E21B 33/03; E21B 33/04; E21B 33/05; E21B 33/06; E21B 33/068; E21B 33/128
See application file for complete search history.

(56) References Cited

U.S. PATENT DOCUMENTS 4,893,678 A * 1/1990 Stokley ..... E21B 33/127 166/238
5,833,002 A * 11/1998 Holcombe ..... E21B 33/05 166/291

* cited by examiner

*Primary Examiner* — Tara Schimpf
*Assistant Examiner* — Dany E Akakpo
(74) *Attorney, Agent, or Firm* — Cantor Colburn LLP

(57) ABSTRACT

An apparatus for retaining and releasing a pump down plug includes an outer housing having a recess and a shifting sleeve that contains the pump down plug and is disposed within the outer housing. The shifting sleeve is configured to slide within the outer housing. The apparatus also includes a retaining element configured to engage the pump down plug to retain the pump down plug, the retaining element being restrained from outward movement by the outer housing in a first position of the shifting sleeve, wherein sliding the shifting sleeve into a second position results in outward movement of the retaining element into the recess to release the pump down plug.

19 Claims, 8 Drawing Sheets

MECHANISM FOR RETAINING AND RELEASING PUMP DOWN PLUG

BACKGROUND

Boreholes are typically drilled into earth formations to explore for and extract hydrocarbons or to sequester carbon dioxide. Once a reservoir of hydrocarbons is discovered, borehole completion activities are required before the hydrocarbons can be extracted or Carbon Dioxide sequestration can be effected.

Some borehole completion activities include cementing operations. For example, the borehole may be lined with a casing that is then cemented in place. In general, cementing operations require holding a pump down plug in place in a work string at the surface while fluid is being pumped downhole in the work string. At a desired time when cement is going to be pumped downhole in the work string, the pump down plug is released to separate the cement from the fluid during the cementing operation. Improvements in holding and releasing the pump down plug would be well received in the hydrocarbon recovery industry.

BRIEF SUMMARY

Disclosed is an apparatus for retaining and releasing a pump down plug. The apparatus includes: an outer housing comprising a recess; a shifting sleeve that contains the pump down plug and is disposed within the outer housing and configured to slide within the outer housing; and a retaining element configured to engage the pump down plug to retain the pump down plug, the retaining element being restrained from outward movement by the outer housing in a first position of the shifting sleeve; wherein sliding the shifting sleeve into a second position results in outward movement of the retaining element into the recess to release the pump down plug.

Also disclosed is a method for retaining and releasing a pump down plug. The method includes: retaining the pump down plug by engaging the pump down plug with a retaining element within in a shifting sleeve that is configured to slide within an outer housing, the retaining element being restrained from outward movement by the outer housing in a first position of the shifting sleeve; and releasing the pump down plug from engagement with the retaining element by sliding the shifting sleeve within the outer housing to a second position such that the retaining element moves outward into a recess in the outer housing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of a plug dropping system for dropping a pump down plug in a work string disposed in a borehole. The pump down plug is contained in a shifting sleeve, which itself is in an outer housing. The shifting sleeve is prevented from sliding in the outer housing by a release latch. The pump down plug is secured by one or more retaining elements, which may be referred to as "dogs," that engage (i.e., contact) a section of the pump down plug and are kept from being released by the geometry of the outer housing that prevents outward movement of the dogs. Once the latch is released, the shifting sleeve slides within the outer housing until the dogs move away from the pump down plug such as outwardly into a recess in the outer housing. The outward movement of the dogs causes the dogs to disengage with the pump down plug causing the pump down plug to be released. The pump down plug then travels downhole in the work string being pushed by a working fluid flowing behind it. The term "working fluid" relates to a fluid necessary for wellbore operations such as cement in a non-limiting embodiment.

Figure 1:
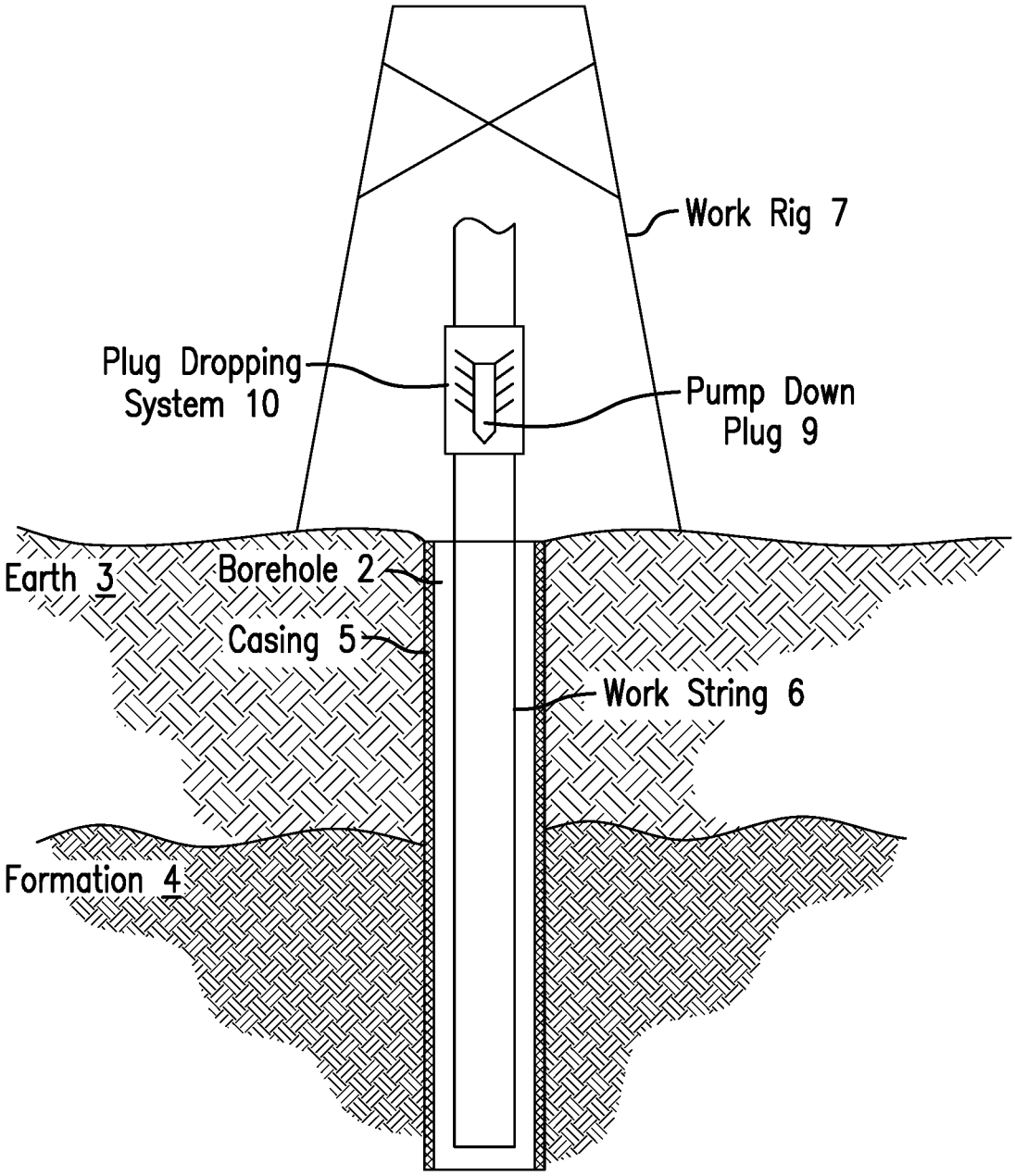
FIG. 1 illustrates a cross-sectional view of an embodiment of a work string having a plug dropping system.

FIG. 1 illustrates a cross-sectional view of a work string 6 disposed in a borehole 2 penetrating the earth 3, which includes a hydrocarbon bearing formation 4. The borehole 2 is lined with a casing 5. Cementing operations may be performed to cement the casing 5 within the borehole 2. The casing 5 may have perforations to allow hydrocarbons to flow into the casing 5 where they are pumped to the surface for production purposes. Topside, a plug dropping system 10 is coupled to the work string 6. The plug dropping system 10 is configured to drop a pump down plug 9. A work rig 7 is configured to perform completion operations such as pumping a displacement fluid and cement into the work string 6 to cement the casing 5 within the borehole 2. The work rig 7 may include material reservoirs, pumps, piping, valves, sensors, and controllers necessary to perform the cementing operations.

Figure 2:
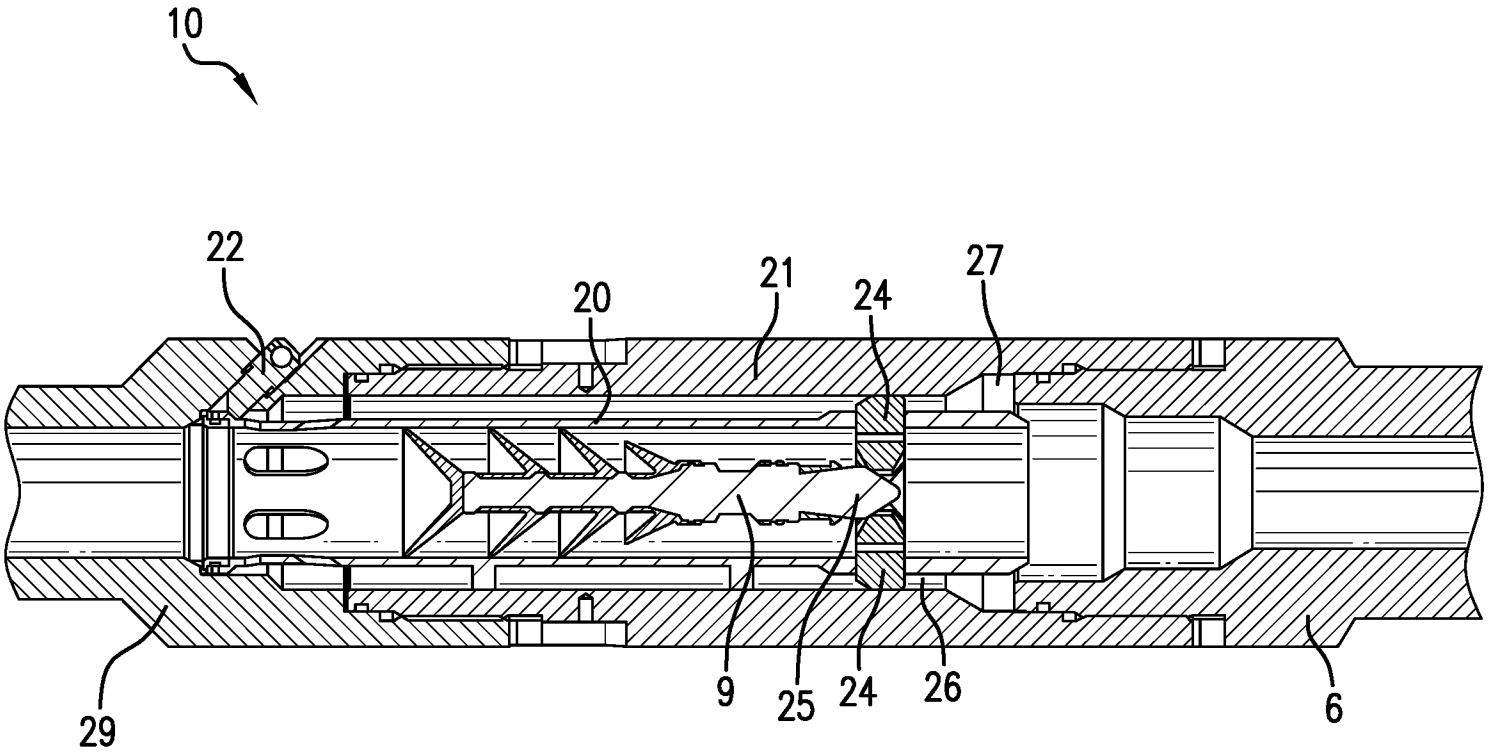
FIG. 2 depicts aspects of a first embodiment of the plug dropping system.

FIG. 2 depicts aspects of a first embodiment of the plug dropping system 10. The pump down plug 9 is disposed in a shifting sleeve 20, which is configured to slide within an outer housing 21. Hence, the outer diameter of the shifting sleeve 20 is less than the inner diameter of the outer housing 21. The shifting sleeve 20 is secured in a locked position (i.e., a first position) with respect to the outer housing 21 by a retainer latch 22. In one or more embodiments, the retainer latch 22 is disposed in a plug dropping head 29 and is manually operated such as by twisting it. In one or more other embodiments, the retainer latch 22 is remotely operated such as by a pneumatically operated actuator that applies a twisting action. It can be appreciated that other types remotely operated actuators and mechanisms may also be used. In the first embodiment, retaining elements 24 engage a nose 25 of the pump down plug 9 to prevent the pump down plug 9 from moving downhole in the work string 6. The retaining elements 24 protrude through holes, windows, or slots in the shifting sleeve 20 and are prevented from moving radially due to contact with an interior portion of the outer housing 21. When the shifting sleeve 20 is locked in the first position, fluid can flow around the shifting sleeve 20 in a bypass annulus 26. As illustrated in FIG. 2, the outer housing 21 include a recess 27 in a downhole direction from where the retaining elements 24 are with the shifting sleeve 20 in the locked first position.

Figure 3:
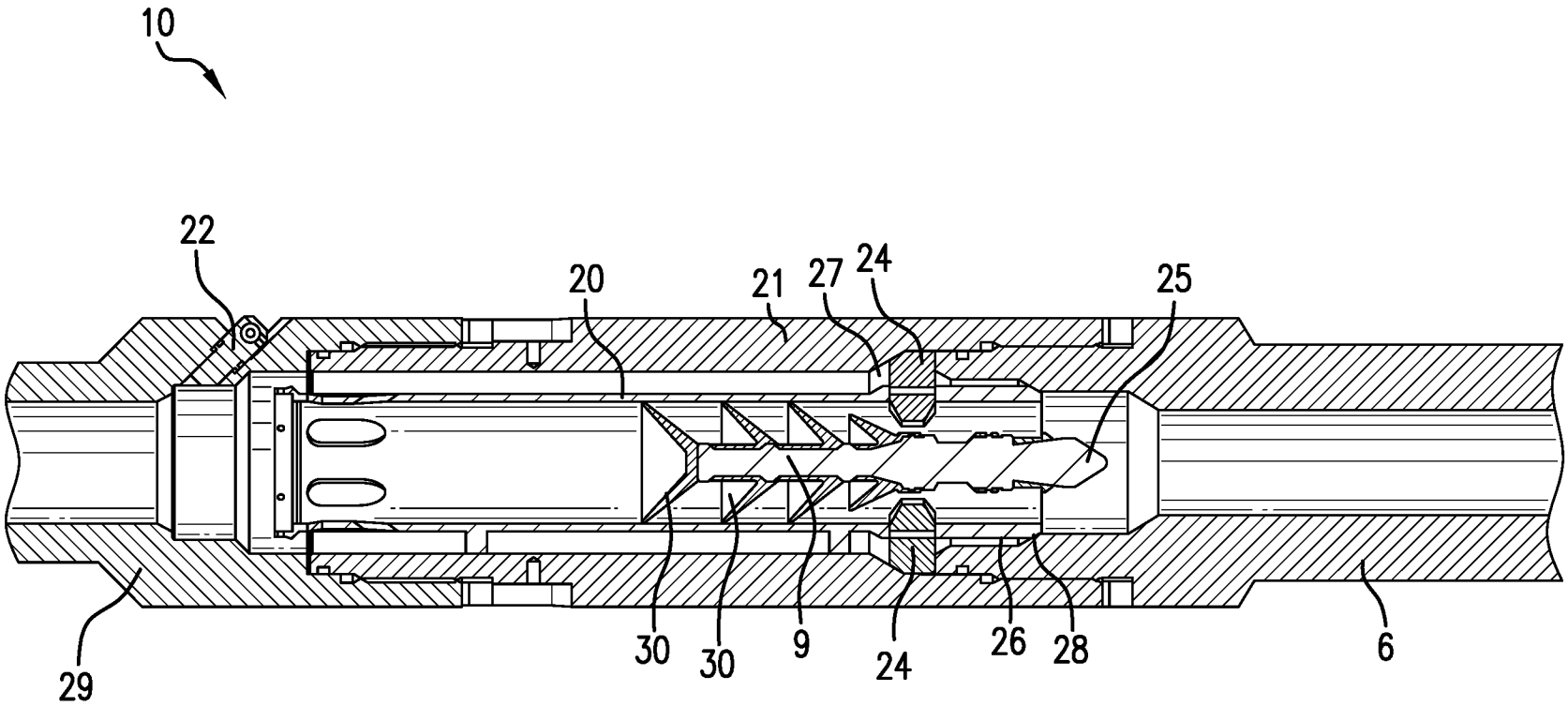
FIG. 3 depicts further aspects of the first embodiment of the plug dropping system.

FIG. 3 depicts aspects of the first embodiment for releasing the pump down plug 9. As illustrated in FIG. 3, the retainer latch 22 has been twisted to disengage from the shifting sleeve 20 thus allowing the shifting sleeve 20 to slide toward the downhole direction. The shifting sleeve 20 slides in the downhole direction due to urging by the working fluid flowing behind the pump down plug 9. Due to the sliding, the retaining elements 24 move towards the recess 27 and move radially into the recess 27 when they reach the location of the recess 27 at a second position of the shifting sleeve 20. The radial movement of the retaining elements 24 is caused by a sloping or beveled edge of the nose 25 engaging with a complementary sloping or beveled edge of the retaining elements 24 such that downhole movement of the pump down plug 9 urges the retaining elements 24 to retract radially. When the retaining elements 24 move radially into the recess 27, the pump down plug 9 is released and free to travel downhole in the work string 6 due to the urging of the flowing working fluid against pliable wipers 30 on the pump down plug 9. Sliding movement of the shifting sleeve 20 is stopped when the shifting sleeve 20 engages (i.e., contacts) the outer housing 21 at point 28. At this point, the bypass annulus 26 is closed off due to the contact of the shifting sleeve 20 with the outer housing 21. Hence, in one or more embodiments, the bypass annulus 26 may be closed off simultaneously or near simultaneously with the release of the pump down plug 9.

Figure 4:
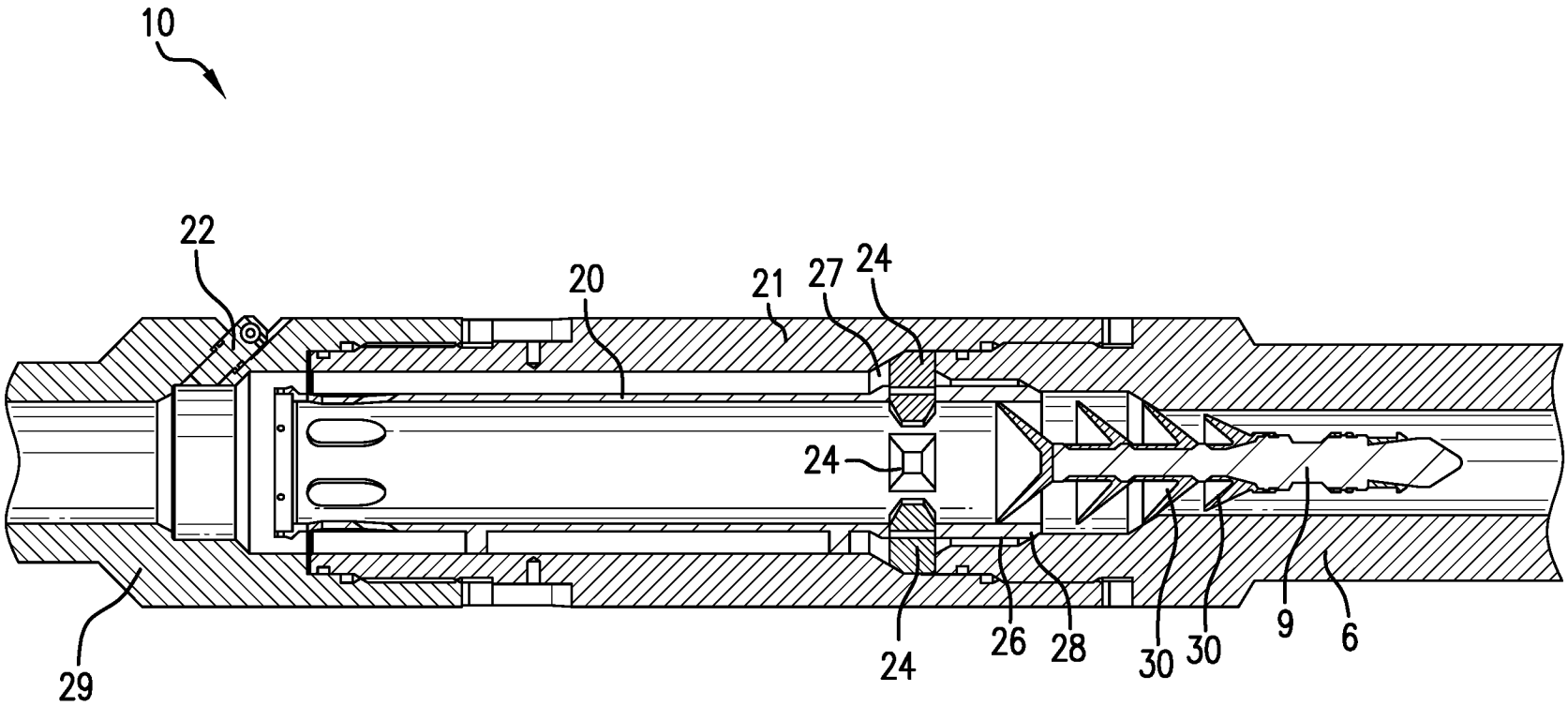
FIG. 4 depicts further aspects of the first embodiment of the plug dropping system.

FIG. 4 depicts aspects of the first embodiment with the pump down plug 9 launched into the work string 6. Note that the retaining elements 24 are withdrawn into the recess 27 and that flow through the bypass annulus 26 is closed off. With the pump down plug 9 launched into the work string 6, the pliable wipers 30 make contact with an interior surface of the work string 6 to wipe off previous flowing fluid that may still be clinging to that surface.

Figure 5:
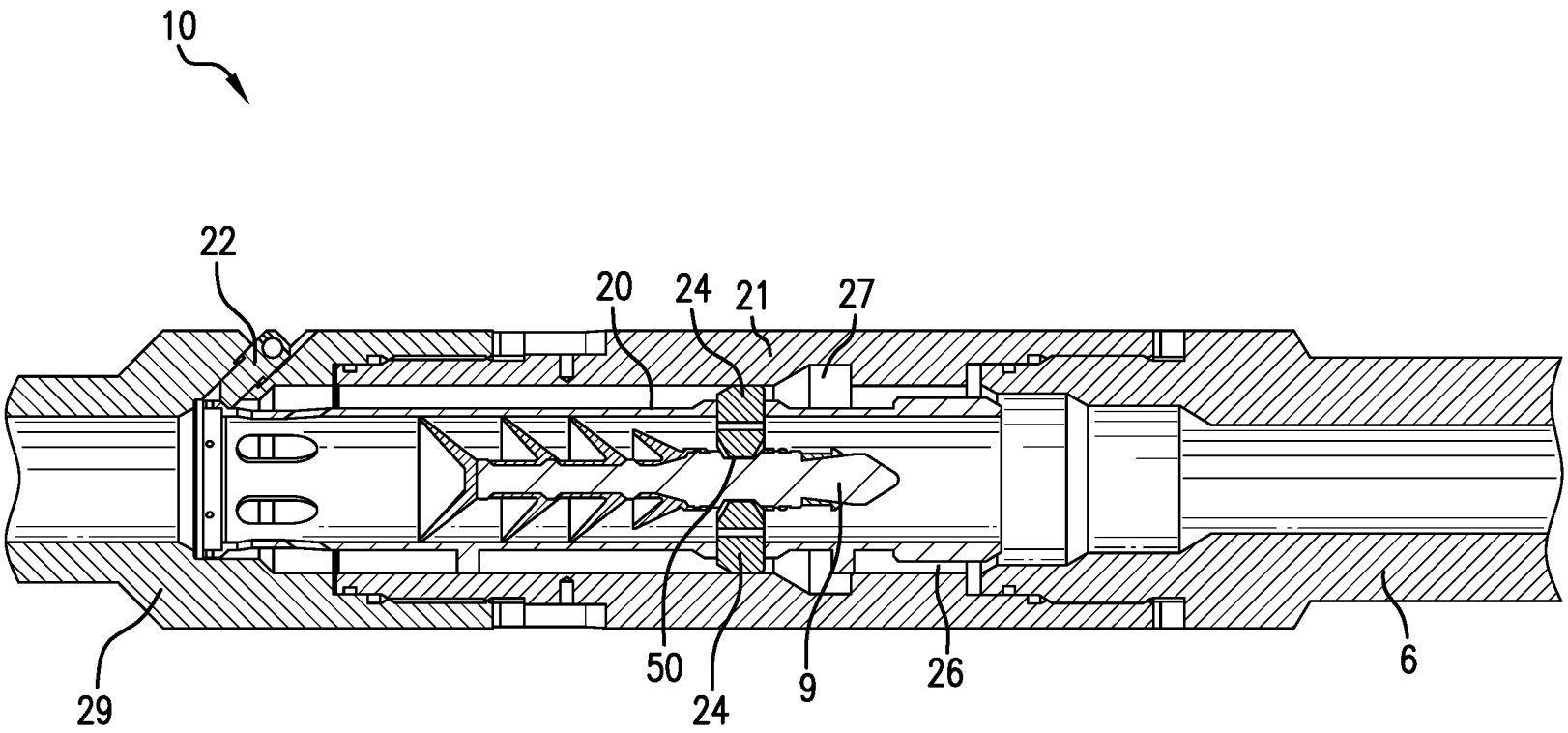
FIG. 5 depicts aspects of a second embodiment of the plug dropping system.

FIG. 5 depicts aspects of a second embodiment of the plug dropping system 10. The second embodiment is similar to the first embodiment in that the same components are used. However, in the second embodiment the retaining elements 24 engage and secure the pump down plug 9 in a different location. In the second embodiment, the retaining elements 24 engage and secure the pump down plug 9 in a pump down plug recess 50 in a midsection of the pump down plug 9. An advantage of the second embodiment is that the pump down plug 9 is secured from moving backwards (i.e., in an out-of-the-borehole direction). Release of the pump down plug 9 in the second embodiment is the same as in the first embodiment in which the retaining elements radially retract into the recess 27. As with the first embodiment, a sloping or beveled edge on the pump down plug recess 50 interfaces with a complementary sloping or beveled edge on each of the retaining elements 24 such that downhole movement of the pump down plug 9 urges the retaining elements 24 to retract radially. FIGS. 3 and 4 are also applicable to illustrating the release and launch of the pump down plug 9, respectively, in the second embodiment.

Figure 6:
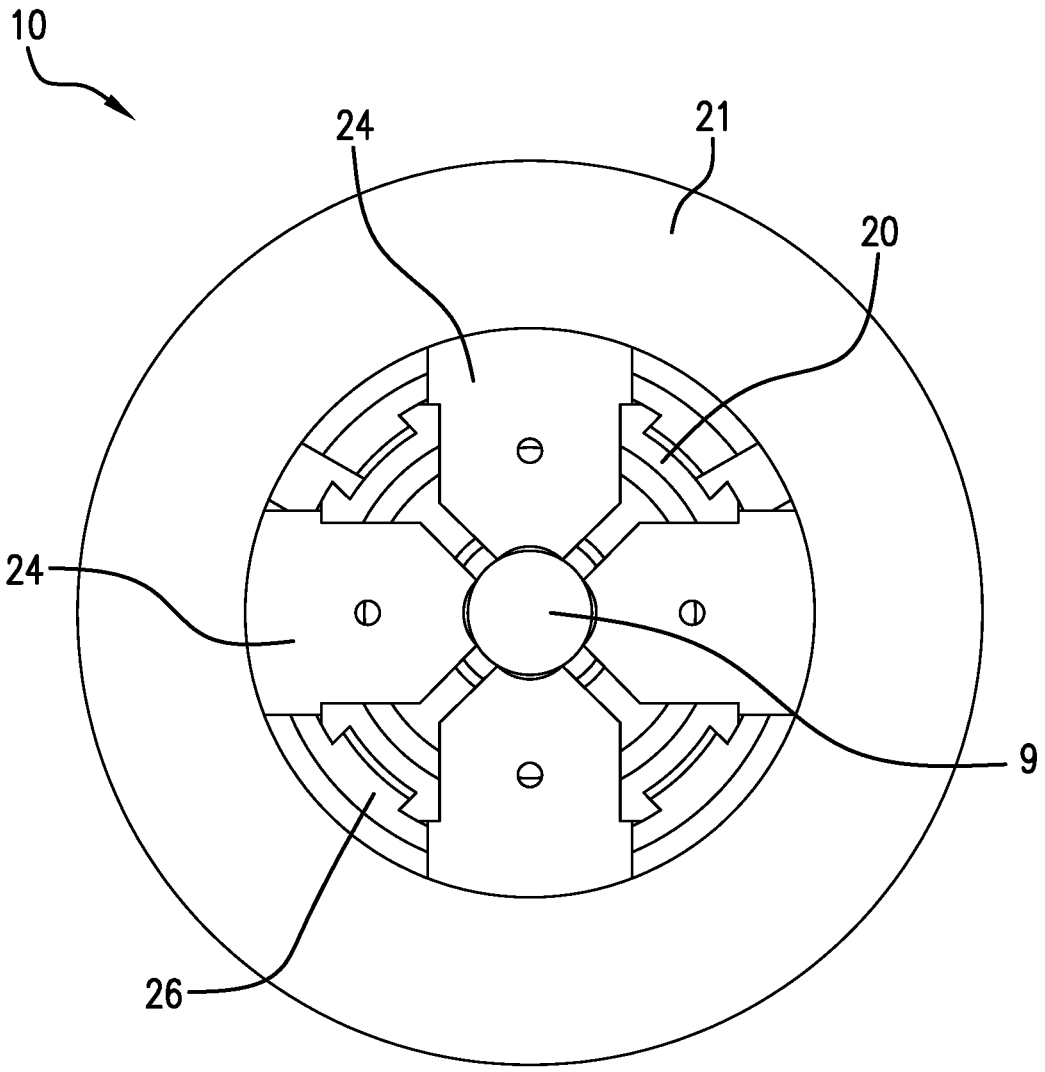
FIG. 6 depicts aspects of retaining elements in the plug dropping system in an end view.

FIG. 6 depicts aspects of the retaining elements 24 in the second embodiment of the plug dropping system 10 in an end view. In the embodiment of FIG. 6, there are four of the retaining elements 24 evenly distributed about the pump down plug 9.

Figure 7:
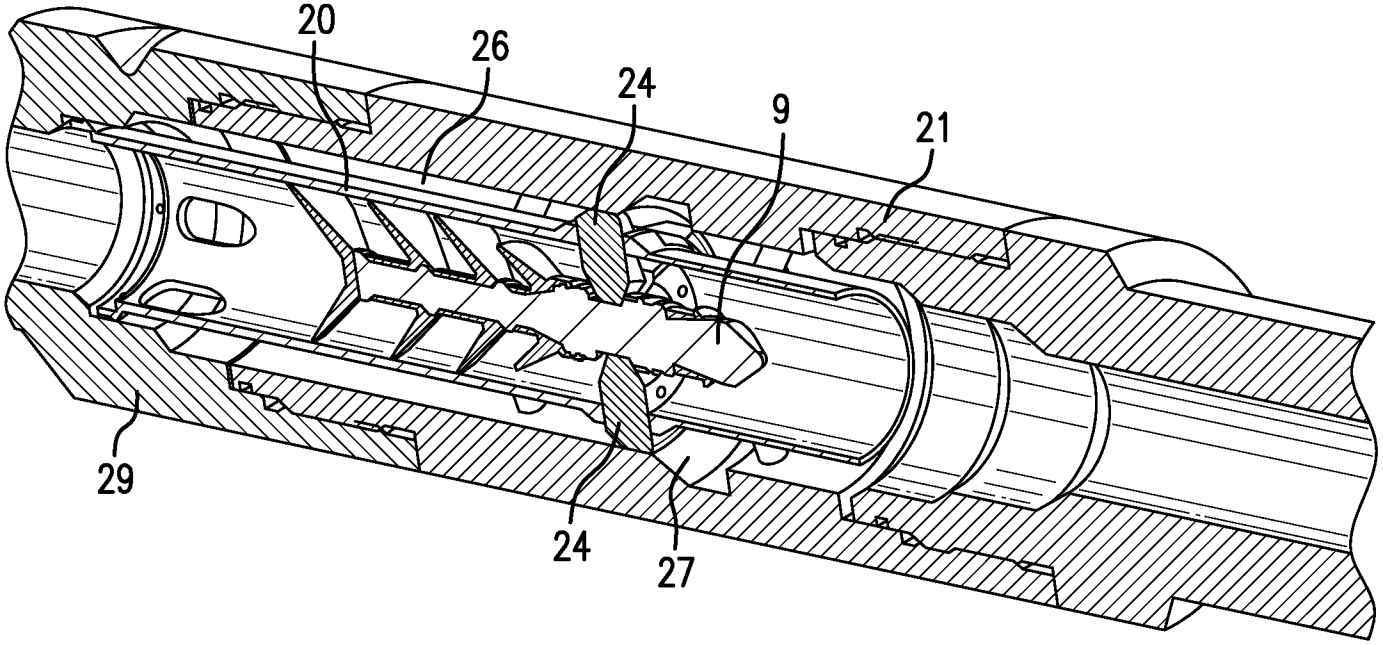
FIG. 7 depicts further aspects of the retaining elements in the plug dropping system in a cut-away perspective view.

FIG. 7 depicts aspects of the retaining elements 24 in the second embodiment of the plug dropping system 10 in a cut-away perspective view.

Figure 8:
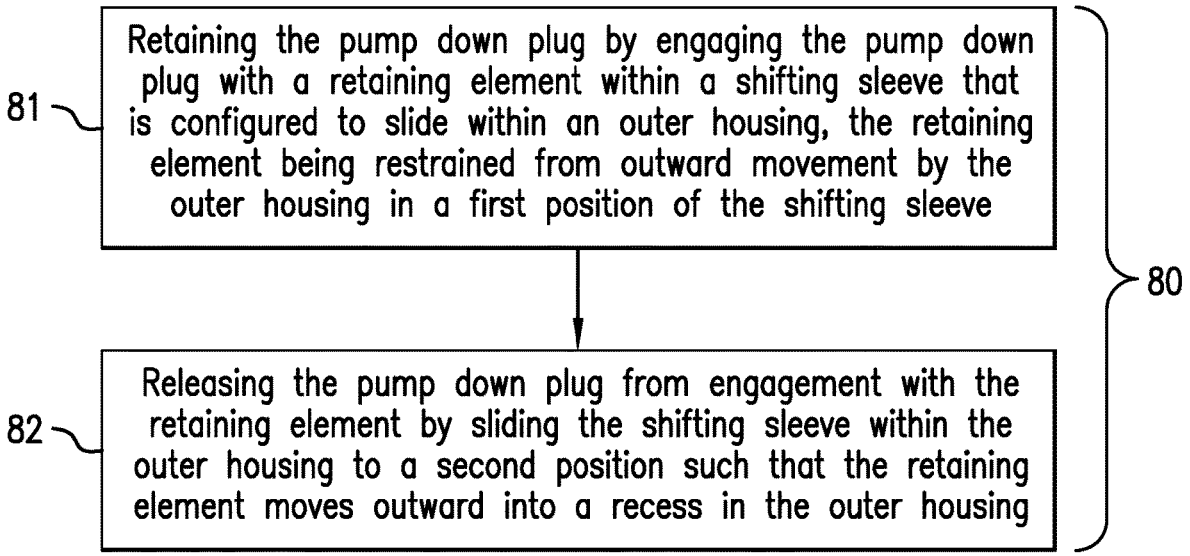
FIG. 8 is a flow chart for a method for holding and releasing a drop down plug.

FIG. 8 is a flow chart for a method 80 for retaining and releasing a pump down plug. Block 81 calls for retaining the pump down plug by engaging the pump down plug with a retaining element within in a shifting sleeve that is configured to slide within an outer housing, the retaining element being restrained from outward movement by the outer housing in a first position of the shifting sleeve. In one or more embodiments, the retaining element engages a nose of the pump down plug. In one or more embodiments, the retaining element engages a recess in a midsection of the pump down plug.

Block 82 calls for releasing the pump down plug from engagement with the retaining element by sliding the shifting sleeve within the outer housing to a second position such that the retaining element moves outward into a recess in the outer housing. In one or more embodiments, the outward movement includes a radially outward vector component. In one or more embodiments, the sliding is terminated at the second position due to engagement (i.e., contact) of the shifting sleeve with the outer housing. In one or more embodiments, the outer housing is coupled to a work string and the pump down plug is released into the work string.

The method 80 may also include releasing the shifting sleeve from a locked position within the outer housing by releasing a retainer latch that engages the shifting sleeve.

The method 80 may also include flowing a fluid in an annulus between the shifting sleeve and the outer housing during the retaining. The method 80 may also include stopping the flowing of the fluid in the annulus due to the releasing of the pump down plug by engagement (i.e., contact) of the shifting sleeve with the outer housing. The engagement or contact may close off the annulus, thus, the flow of the fluid in the annulus may be stopped simultaneously with the release of the pump down plug.

The disclosure herein provides several advantages. The advantages relate to the plug dropping system 10 being more reliable and robust compared to prior art plug dropping mechanisms, in particular, those that utilize a flapper door. Flapper doors are subject to limitations based upon the strength of a hinge pin for the flapper door. The hinge pin is subject to shear loading forces due to forces acting on the back of the pump down plug prior to releasing the pump down plug. Flapper doors have been known to become stuck due to debris in either in the flapper door or in a path or opening into which the flapper door must open. Also, flapper doors have been known to get pinched or oriented "backward" and thus cannot function. In addition, retaining pins are required to hold the pump down plug in a launch position for release using the flapper door configuration. The retaining pins only have a single point of contact against a relatively flexible tail fin of the pump down plug. Consequently, the pump down plug can get shifted upward, out of its intended launch position, and thereby prevent a successful launch of the pump down plug.

The plug dropping system 10 avoids the problems associated with the flapper door plug dropping system. The retaining elements 24 eliminates the strength issues with the flapper door hinge. The retaining force in the plug dropping system 10 is applied by the beveled face of the retaining elements 24, which are resisted from moving outward by the circumferential support of the inner surface of the outer housing 21. The hoop strength of the circumferential outer housing provides support to resist the opening of the aperture defined by the retaining elements 24 and allows lower stresses to be experienced by the system 10.

Since the retaining elements 24 stroke radially outward, they move outward into the recess 27 as opposed to opening into the main fluid flow path. In addition, the plug dropping system 10 cannot get pinched or oriented in a backward direction due to the geometry and fitment of the retaining elements 24.

The second embodiment as illustrated in FIG. 5 provides secure 360-degree engagement with the body of the pump down plug 9 as opposed to a single point of contact on the tail end of the of the pump down plug, thereby precluding any potential for the pump down plug moving from its launch position prior to the pump down plug being released.

Set forth below are some embodiments of the foregoing disclosure:

Embodiment 1: An apparatus for retaining and releasing a pump down plug, the apparatus comprising: an outer housing comprising a recess, a shifting sleeve that contains the pump down plug and is disposed within the outer housing and configured to slide within the outer housing, and a retaining element configured to engage the pump down plug to retain the pump down plug, the retaining element being restrained from outward movement by the outer housing in a first position of the shifting sleeve wherein sliding the shifting sleeve into a second position results in outward movement of the retaining element into the recess to release the pump down plug.

Embodiment 2: The apparatus according to any previous embodiment, wherein the outer housing is coupled to a plug dropping head comprising a retainer latch for locking the shifting sleeve in the first position.

Embodiment 3: The apparatus according to any previous embodiment, wherein the retaining element comprises a radial length sufficient to engage a nose of the pump down plug with the shifting sleeve in the first position.

Embodiment 4: The apparatus according to any previous embodiment, wherein the retaining element comprises a radial length sufficient to engage a recess in a midsection of the pump down plug with the shifting sleeve in the first position.

Embodiment 5: The apparatus according to any previous embodiment, wherein the shifting sleeve disposed within the outer housing defines an annulus through which fluid can flow with the shifting sleeve in the first position.

Embodiment 6: The apparatus according to any previous embodiment, wherein fluid flow through the annulus is blocked with the shifting sleeve in the second position by engagement of the shifting sleeve with the outer housing.

Embodiment 7: The apparatus according to any previous embodiment, wherein the outer housing is coupled to a work string and the pump down plug travels in the work string upon release.

Embodiment 8: The apparatus according to any previous embodiment, wherein the outward movement of the retaining element with the shifting sleeve in the second position comprises an outward radial vector component.

Embodiment 9: A method for retaining and releasing a pump down plug, the method comprising: retaining the pump down plug by engaging the pump down plug with a retaining element within in a shifting sleeve that is configured to slide within an outer housing, the retaining element being restrained from outward movement by the outer housing in a first position of the shifting sleeve, and releasing the pump down plug from engagement with the retaining element by sliding the shifting sleeve within the outer housing to a second position such that the retaining element moves outward into a recess in the outer housing.

Embodiment 10: The method according to any previous embodiment, further comprising releasing the shifting sleeve from the first position within the outer housing by releasing a retainer latch that engages the shifting sleeve.

Embodiment 11: The method according to any previous embodiment, further comprising flowing a fluid in an annulus between the shifting sleeve and the outer housing during the retaining.

Embodiment 12: The method according to any previous embodiment, further comprising stopping the flowing of the fluid in the annulus due to the releasing of the pump down plug by engagement of the shifting sleeve with the outer housing.

Embodiment 13: The method according to any previous embodiment, wherein the flowing of the fluid in the annulus is stopped simultaneously with the releasing of the pump down plug.

Embodiment 14: The method according to any previous embodiment, wherein the pump down plug travels in a work string that is coupled to the outer housing upon release of the pump down plug.

Embodiment 15: The method according to any previous embodiment, wherein the outward movement comprises an outward radial vector component.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are not intended to denote a particular order but are used to differentiate elements.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for retaining and releasing a pump down plug, the apparatus comprising:

an outer housing comprising a housing recess;

a shifting sleeve that contains the pump down plug and is disposed within the outer housing and configured to slide within the outer housing, the pump down plug being elongated and having a nose end and an opposing end and the pump down plug defining a plug recess that extends below an outer diameter of the pump down plug at the plug recess between the nose end and the opposing end; and a retaining element configured to engage the plug recess of the pump down plug to retain the pump down plug, the retaining element being restrained from outward movement by the outer housing in a first position of the shifting sleeve;

wherein sliding the shifting sleeve into a second position results in outward movement of the retaining element into the housing recess to release the pump down plug.

2. The apparatus according to claim 1, wherein the outer housing is coupled to a plug dropping head comprising a retainer latch for locking the shifting sleeve in the first position.

3. The apparatus according to claim 1, wherein the retaining element comprises a radial length sufficient to engage the plug recess of the pump down plug with the shifting sleeve in the first position.

4. The apparatus according to claim 1, wherein the shifting sleeve disposed within the outer housing defines an annulus through which fluid can flow with the shifting sleeve in the first position.

5. The apparatus according to claim 4, wherein fluid flow through the annulus is blocked with the shifting sleeve in the second position by engagement of the shifting sleeve with the outer housing.

6. The apparatus according to claim 1, wherein the outer housing is coupled to a work string and the pump down plug travels in the work string upon release.

7. The apparatus according to claim 1, wherein the outward movement of the retaining element with the shifting sleeve in the second position comprises an outward radial vector component.

8. The apparatus according to claim 1, wherein the retaining element comprises a plurality of retaining elements.

9. The apparatus according to claim 8, wherein the plurality of retaining elements are circumferentially disposed about the pump down plug.

10. The apparatus according to claim 9, wherein the plurality of retaining elements are evenly distributed about the pump down plug.

11. The apparatus according to claim 1, wherein the plug recess comprises a beveled edge configured to engage with the retaining element.

12. A method for retaining and releasing a pump down plug, the method comprising:

retaining the pump down plug, the pump down plug being elongated and having a nose end and an opposing end and the pump down plug defining a plug recess that extends below an outer diameter of the pump down plug at the plug recess between the nose end and the opposing end, by engaging the plug recess of the pump down plug with a retaining element within in a shifting sleeve that is configured to slide within an outer housing, the retaining element being restrained from outward movement by the outer housing in a first position of the shifting sleeve; and releasing the pump down plug from engagement with the retaining element by sliding the shifting sleeve within the outer housing to a second position such that the retaining element moves outward into a housing recess in the outer housing.

13. The method according to claim 12, further comprising releasing the shifting sleeve from the first position within the outer housing by releasing a retainer latch that engages the shifting sleeve.

14. The method according to claim 12, further comprising flowing a fluid in an annulus between the shifting sleeve and the outer housing during the retaining.

15. The method according to claim 14, further comprising stopping the flowing of the fluid in the annulus due to the releasing of the pump down plug by engagement of the shifting sleeve with the outer housing.

16. The method according to claim 15, wherein the flowing of the fluid in the annulus is stopped simultaneously with the releasing of the pump down plug.

17. The method according to claim 12, wherein the pump down plug travels in a work string that is coupled to the outer housing upon release of the pump down plug.

18. The method according to claim 12, wherein the outward movement comprises an outward radial vector component.

19. The method according to claim 12, wherein releasing the pump down plug from engagement with the retaining element comprises the retaining element engaging with a beveled edge of the plug recess to urge the retaining element to retract radially.

* * * * *